US005921429A

United States Patent [19]

Gruenbacher et al.

[11] Patent Number: 5,921,429

[45] Date of Patent: Jul. 13, 1999

[54] CONTAINER FOR MULTIPLE SIDE-BY-SIDE STACKS OF FRAGILE ARTICLES

[75] Inventors: Dana P. Gruenbacher, Fairfield; Douglas B. Zeik, Middletown; Daniel J. Kinne, Cincinnati, all of Ohio

[73] Assignee: The Procter & Gamble Company, Cincinnati, Ohio

[21] Appl. No.: 08/928,053

[22] Filed: Sep. 12, 1997

[51] Int. Cl.[6] ..... B65D 35/00

[52] U.S. Cl. ..... 220/555; 215/6

[58] Field of Search ..... 220/523, 553, 220/555, 671, 673, 675, 258; 215/6

[56] References Cited

U.S. PATENT DOCUMENTS

| | | | |
|---|---|---|---|
| 4,065,536 | 12/1977 | Lucas | 215/6 X |
| 4,889,255 | 12/1989 | Schiemann | 215/6 X |
| 5,223,245 | 6/1993 | Ibrahim et al. | 215/6 X |
| 5,269,441 | 12/1993 | O'Meara | 215/6 X |
| 5,325,976 | 7/1994 | Valyi et al. | 220/258 X |
| 5,692,626 | 12/1997 | Wehrle et al. | 215/6 |

*Primary Examiner*—Steven Pollard

*Attorney, Agent, or Firm*—Ronald W. Kock; Jack L. Oney, Jr.

[57] ABSTRACT

A plastic container for multiple side-by-side stacks of fragile articles has a single blow molded body. The body has side walls and at least one internal partition extending from near a continuously rimmed open top to near a closed bottom end of the body. The partition has two spaced apart walls connected in a longitudinal plane substantially perpendicular to said at least one partition. The partition forms at least two separated compartments within the body for supporting the stacks of fragile articles. It provides resistance to squeezing the side walls so as to protect the stacks of fragile articles, and the two spaced apart walls are adapted to deform in the presence of vacuum and pressure in the compartments such that an outer perimeter dimension of the body remains substantially constant. The container also has a reclosable closure located at the continuously rimmed top end of the body.

18 Claims, 2 Drawing Sheets

CONTAINER FOR MULTIPLE SIDE-BY-SIDE STACKS OF FRAGILE ARTICLES

FIELD OF THE INVENTION

The present invention relates to packages for fragile articles, such as shaped potato chips, and more particularly to such packages wherein multiple stacks are located side-by-side and it is desirable to avoid contact between stacks. Even more particularly, the present invention relates to such packages wherein the primary container is made by a blow molding process.

BACKGROUND OF THE INVENTION

PRINGLES POTATO CRISPS® (Pringles) is a trademark of The Procter & Gamble Company of Cincinnati, Ohio. Pringles are commonly shaped individual snack articles having a "saddle" shape, which have been packaged as a single stack of articles in a cylindrical fiberboard laminated can. Several cans may be bundled together in order to sell multiple stacks in a single package. However, multiple cans represent an expensive package. More desirable is a package which has one primary container with a provision for multiple stacks of articles therein.

Pringles and other pre-shaped snack articles are typically fragile and easily broken in rough handling. They are especially susceptible to breakage when stacks contact one another and experience vibration during shipping or when a consumer squeezes a container wall and thereby presses against the curved edges of an article or stack of articles to generate single point contact on opposing sides of the article or stack of articles.

What is needed is an inexpensive single container for multiple stacks of such fragile articles, which withstands the typical hand squeezing forces and separates the stacks such that vibratory contact cannot occur between them. In particular a two stack container is needed.

One reason a cylindrical can has been used for the oval shaped Pringles articles is that each package is first evacuated and then packed under nitrogen. When exposed to shipping over mountains where external atmospheric pressure is two thirds of that at sea level, internal can pressures of 2–4 pounds per square inch may result. A cylindrical can will maintain its shape under these internal vacuum and pressure conditions more easily than any other shape except for a spherical can, which is impractical. However, a cylindrical container for two side-by-side stacks of oval articles would provide considerable empty space within the container and would be excessively large for one-handed handling (over four inches in diameter).

What is needed is a substantially rectangular container for two side-by-side stacks of articles such that container size is minimized and is easily grasped in one hand, but which will maintain its external shape when evacuated or pressurized so that a wrap around label will retain its fit.

Plastic bottles have long been made by blow molding because blow molding provides an inexpensive process and bottle construction. Compartmented packages are found in the art too. However, compartmented blow molded packages are uncommon because of the nature of the blow molding process, which expands a single parison against an internal mold wall. Blow molded containers can be made with multiple layers to incorporate different types of materials possessing barrier properties, e.g. oxygen barrier, also to allow colorants to be used only on the outside of the package and to incorporate regrind back into the package. Containers having corrugations for increasing side wall strength are also found in the art. However, the combination of all of these features has not been found in the art.

What is needed is a blow molded container having two separate compartments to protect fragile products and corrugated side walls to minimize material while providing deflection strength for squeeze strength as well as pressure/vacuum resistance, and which is made of an inexpensive oxygen and moisture barrier structure.

SUMMARY OF THE INVENTION

In one aspect of the present invention, a plastic container for multiple side-by-side stacks of fragile articles comprises a single blow molded body having side walls and at least one internal partition extending from near a continuously rimmed open top to a bottom end of the body. The at least one partition has two spaced apart walls connected in a longitudinal plane substantially perpendicular to said at least one partition. The at least one partition forms at least two separated compartments within the body for supporting the stacks of fragile articles. The at least one partition provides resistance to squeezing the side walls so as to protect the stacks of fragile articles. The container also comprises a closed bottom portion connected to each of the at least two separated compartments. The closed bottom portion of one compartment is separated from a closed bottom portion of another compartment by the two spaced apart walls of the at least one internal partition. Another element of the container is a reclosable closure located at the continuously rimmed top end of the body which closes the at least two separated compartments.

The single blow molded body is substantially rectangular in shape in order to reduce an overall size of the container for ease of one-handed handling. The side walls are preferably corrugated from the continuously rimmed top end to the bottom end of the single blow molded body to increase stiffness of the side walls to squeezing in order to further protect the stacks of fragile articles from damage. The two spaced apart walls are adapted to deform in the presence of vacuum and pressure occurring in the at least two spaced apart compartments such that an outer perimeter dimension of the body remains substantially constant.

The single blow molded body is preferably blown from a multilayer parison comprising layers of high density polyethylene, ethylene vinyl alcohol, and adhesive tie layers to provide lowest cost moisture and oxygen barriers.

A substantially rigid pinch off rib is preferably located within a pushup region at the bottom end. The rib is substantially parallel to the longitudinal plane and connected to the closed bottom portion of each of the at least two separated compartments to stiffen each closed bottom portion in the presence of vacuum and pressure in the container.

Preferably, the container also has overlapping peel closures for each of the at least two separated compartments. The overlapping peel closures are preferably located inside the reclosable closure and are removable one at a time in order to retain the multiple stacks of fragile articles in the at least two separated compartments while one of the at least two compartments is opened for removal of one of the multiple stacks of fragile articles.

In another aspect of the present invention, a plastic container for multiple side-by-side stacks of fragile articles comprises a single blow molded body having side walls and at least one internal partition extending from near a continuously rimmed open top to near a closed bottom end of the single blow molded body. The at least one partition has two spaced apart walls connected in a longitudinal plane substantially perpendicular to said at least one partition. The at least one partition forms at least two separated compartments within the body for supporting the fragile articles and providing resistance to squeezing the side walls so as to protect the stacks of fragile articles. The two spaced apart walls are adapted to deform in the presence of vacuum and pressure occurring in the at least two spaced apart compartments such that an outer perimeter dimension of the body remains substantially constant. The container also includes a reclosable closure located at the continuously rimmed top end of the body which closes the at least two separated compartments.

The side walls are preferably corrugated from the continuously rimmed top end to the closed bottom end of the single blow molded body to increase stiffness of the side walls to squeezing in order to further protect the multiple side-by-side stacks of fragile articles from damage. The single blow molded body is substantially rectangular in shape in order to reduce an overall size of the container for ease of one-handed handling.

The single blow molded body is preferably blown from a multilayer parison comprising layers of high density polyethylene, ethylene vinyl alcohol, and adhesive tie layers to provide lowest cost moisture and oxygen barriers.

A substantially rigid pinch off rib is preferably located within a pushup region at the closed bottom end. The rib is substantially parallel to the longitudinal plane to stiffen the closed bottom end in the presence of vacuum and pressure in the container.

Preferably there is an overlapping peel closures for each of the at least two separated compartments. The overlapping peel closures are preferably located inside the reclosable closure and are removable one at a time in order to retain the multiple stacks of fragile articles in the at least two separated compartments while one of the at least two compartments is opened for removal of one of the multiple side-by-side stacks of fragile articles.

BRIEF DESCRIPTION OF THE DRAWINGS

While the specification concludes with claims which particularly point out and distinctly claim the present invention, it is believed that the present invention will be better understood from the following description of preferred embodiments, taken in conjunction with the accompanying drawings, in which like reference numerals identify identical elements and wherein:

DETAILED DESCRIPTION OF THE INVENTION

Figure 2:
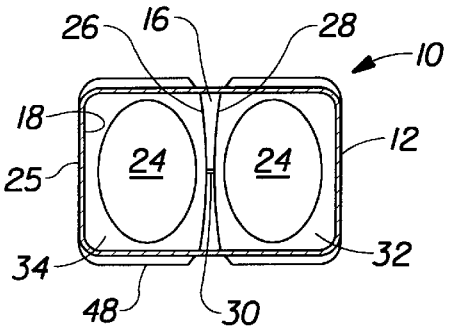
FIG. 2 is a sectioned top plan view thereof, taken along section line 2—2 of FIG. 1, showing two internal compartments for housing two stacks of oval articles, wherein the compartments are formed by vertical indentations from both the front and back of the container, which meet at the center of the container to form a center partition.

Referring now to the drawings, and more particularly to FIGS. 1, 2, 3, and 4, there is shown a first preferred embodiment of the present invention, which provides a container for multiple side-by-side stacks of fragile articles, which is generally indicated as 10. Container 10 has a single blow molded body 12. Body 12 has side walls 14, an internal partition 16, a continuously rimmed open top 18, and a bottom end 20. Body 12 is substantially rectangular in shape in order to reduce an overall size of the container holding multiple stacks of articles for ease of one-handed handling. The narrowest side need only be a width slightly greater than the longest dimension of one of the stacked articles. For the intended Pringles article, the narrowest side is preferably about 7.5 cm, which is easily grasped in one hand.

Body 12 is preferably blow molded to the desired shape because blow molding is believed to provide the least expensive container made of multiple barrier layers in this shape. The single blow molded body is blown from a multilayer parison having layers of high density polyethylene (HDPE) and ethylene vinyl alcohol (EVOH) and tie layers, as hereinafter described. The HDPE layers provide moisture resistance and the EVOH layer provides an oxygen barrier. The two different material layers are bonded together by tie layers in a 20–30 mil thick blown structure. Together these materials are believed to be the least expensive resins for the required moisture and oxygen barrier.

Side walls 14 preferably have horizontally oriented corrugations 22 on the front and back portions to provide increased stiffness to the side walls when they are squeezed during container handling. The corrugations preferably extend from near the continuously rimmed top end of the container to the bottom end. Increased stiffness is intended to protect a stack of fragile articles 24, which may be located within container 10. Stack of fragile articles 24 may include food snacks such as pretzels, crackers, potato chips, or other brittle articles; but container 10 is intended to hold stacks of Pringles, which are commonly shaped articles, each made from potato flour and molded and fried to a saddle shape. The preferred corrugated rib geometry is a continuous sinusoidal wave with a 0.2 inch radius, 0.06 inch depth and a 0.42 inch repeat length. This rib dimension is believed to be the maximum radius and depth that can be tolerated without causing Pringles breakage during loading of the container and removal of Pringles during consumer use. A more gentle radius and depth would be preferred for chip loading and removal however, this will also decrease the strength of the side walls.

Side walls 14 preferably have substantially flat end portions 25 which make blow mold half separation easier than if they were corrugated and which provide a flat surface for attaching a wrap around label. Flat end portions also improve single line conveying of container 10 end-to-end with similar containers.

Internal partition 16 preferably crosses between the front and back side walls of the container, substantially centered therein, and extends from near the continuously rimmed top end of the container to the bottom end. Partition 16 is the result of vertical indentations in the front and back side walls of the container. Partition 16 has two spaced apart walls 26 and 28 formed during blow molding by two tapered mold protrusions which indent laterally about half the width of the container so that when the blow mold halves come together, the protrusions nearly contact along a longitudinal axis of the container. The protrusions cause spaced apart walls 26 and 28 to be pinched together at a plane 30 along the longitudinal axis. The plane is substantially perpendicular to internal partition 16 and the pinched together portion of the plastic walls remains connected after molding.

Internal partition 16 forms two separated compartments 32 and 34 within body 12, which serve to separate the two stacks of fragile articles 24. The partition also serves to increase the stiffness of the substantially rectangular container side walls from hand squeezing and pressure/vacuum forces so as to protect the stacks of fragile articles from being crushed.

Continuously rimmed open top 18 surrounds both stacks of fragile articles and extends slightly above them. Open top 18 is adapted to receive a closure to close the container air-tight for shipping and storage. A primary closure is preferably a set of overlapping peel closures 36 and 38, which are heat sealed to the rim of open top 18. They preferably have tabs extending outward from container 10 for removal purposes. Overlapping peel closure 36 spans across one of the separated compartments 32 or 34 and overlapping peel closure 38 spans across both peel closure 36 and the other of separated compartments 32 or 34. Peel closure 38 seals not only to a portion of the rim but also to the outside perimeter of peel closure 36. In this way, the container is opened by peeling off closure 38 to expose, for example, compartment 32 while compartment 34 remains closed. Having two independently peelable closures permits removal of one stack of articles 24 from container 10 without the other stack of articles falling out. Then when the first stack is removed, the second stack can be accessed by peeling off closure 36. Of course, the primary closure could alternatively include only peel closure 38 and both stacks could be accessed simultaneously. The purpose of a primary closure is to provide a gas-tight seal because container 10 is preferably flushed with nitrogen to displace oxygen from the container in order to maintain the freshness of the container contents. Peel closures 36 and 38 preferably have an aluminum foil component to provide a moisture and oxygen barrier.

Figure 5:
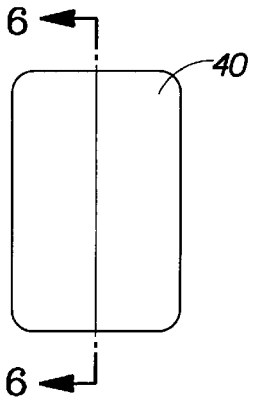
FIG. 5 is a top plan view of a snap-on lid for the preferred container.
Figure 6:
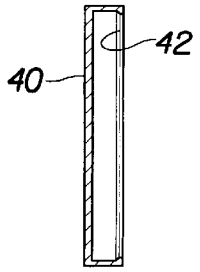
FIG. 6 is a sectioned front elevation thereof, taken along section line 6—6 of FIG. 5, showing a snap bead in the lid.
Figure 1:
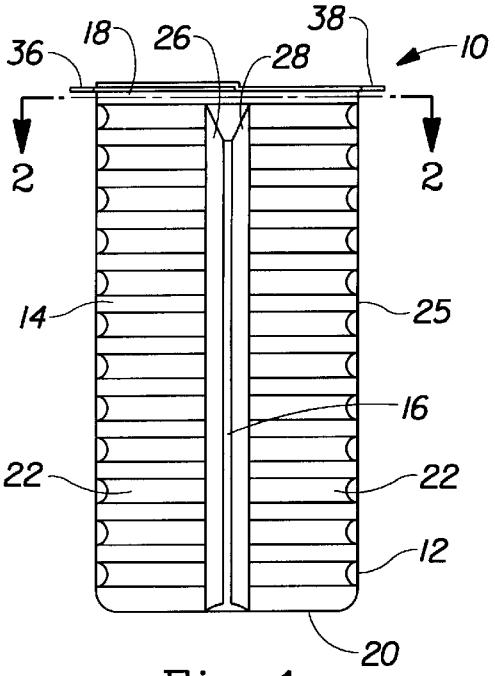
FIG. 1 is a front elevation view of a preferred embodiment of the container for multiple stacks of side-by-side fragile articles of the present invention, disclosing a plastic container having horizontally corrugated front side walls, a continuous top rim, a dual peel-off closure attached to the top rim, and a vertical indentation at the center of the container.
Figure 4:
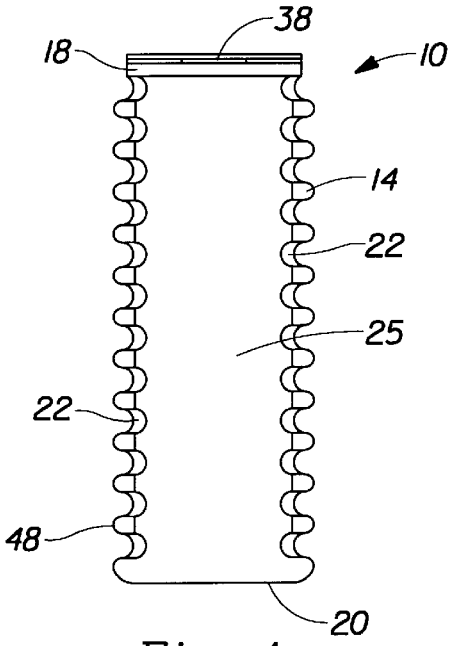
FIG. 4 is a right side elevation thereof, more clearly showing the corrugated front and back side walls and a substantially flat right side wall for labeling purposes.
Figure 3:
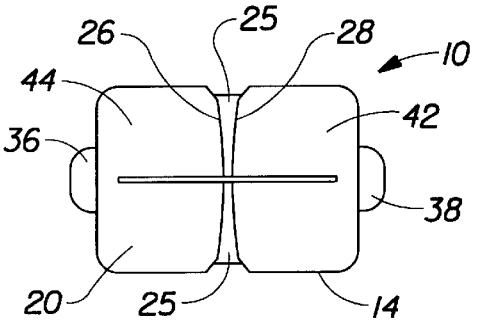
FIG. 3 is a bottom plan view thereof, showing two separate bottom portions connected together by a vertical rib, which is substantially centered between and parallel to the front and back sides of the container.

A secondary closure 40 may be useful, as is shown in FIGS. 5 and 6. Secondary closure 40 is preferably a substantially rigid snap-on cap, having a bead 42 to enable snapping onto the rim of open top 18. Closure 40 could also be designed as a primary closure if peelable closures were not needed for maintaining internal nitrogen pressure or vacuum inside container 12. Secondary closure 40 is preferably a reclosable closure such that after the primary closure is removed, the secondary closure can be used to close the container so that articles therein remain protected from contamination and damage, even though the original package atmosphere of nitrogen may have escaped. Secondary closure 40 is preferably injection molded or thermoformed HDPE.

Bottom end 20 is unusual in that there are two closed bottom portions 42 and 44 of single blow molded body 12. Bottom portion 42 closes compartment 32 and bottom portion 44 closes compartment 34. Bottom portions 42 and 44 may be blow molded as part of body 12 or formed separately and connected thereto by a fusion welding process. Bottom end 20 is divided into two portions by internal partition 16, whose spaced apart walls 26 and 28 extend all the way to the bottom of container 10.

Bottom portions 42 and 44 preferably have pushups, or concave bottom surfaces (not shown) which provide deflection strength due to their curvature and an area to pinch off the parison which doesn't extend below the bottom of the container. As a result of the pinch off, common to blow molding, a substantially rigid rib 46 is generated across bottom end 20. Rib 46 is preferably parallel to longitudinal plane 30 and connected thereto. Rib 46 extends continuously across both closed bottom portions 42 and 44 and across the gap between spaced apart walls 28 and 26 to stiffen bottom end 20 when compartments 32 and 34 are exposed to either vacuum or pressure.

The exposure to vacuum or pressure would cause sealed substantially rectangular container 10 to become more rounded or more like a figure eight shape. Such outer shape change is undesirable when a label is wrapped around an outer perimeter 48 of container 10. To resist such shape change, the spaced apart walls 26 and 28 of internal partition 16 are made thin enough to deflect. It has been found that such wall deflection helps to reduce the internal pressures of nitrogen packing and the vacuum associated with altitude changes, in order to change the internal volume of container 10 without substantially disturbing its outer perimeter 48.

In a particularly preferred embodiment, container 10 is about 28 cm tall, about 7.5 cm front to back, and about 12.5 cm end to end. It has side walls and closed bottom portions about 30 mils thick. Internal partition walls are of similar thickness and are spaced about 12 mm apart, gradually tapered to about 3 mm spacing near the center of the container. Rib 46 is preferably about 4 mm tall and about 1 mm thick and about 10.5 mm long. Peel closures 36 and 38 are preferably 2.8 mil in total thickness and are made of layers including 2 mil SURLYN®, an isomer and Trademark of E. I. DuPont de Nemours Co. of Wilmington, Del.; 0.285 mil aluminum foil; 0.5 mil coextrusion of polyethylene and ethylene acrylic acid (EAA); and 0.48 mil polyethylene terephthalate (PET).

The method of blow molding the preferred embodiments of the present invention has the typical steps of first applying heat and pressure to plastic resin pellets to soften them so that they may be forced through a parison die orifice. This first step of extrusion produces multiple layers in a parison by having separate extruders for each resin feeding a multiple ring die having concentric annular orifices, such that the layers come together near the die exit. The preferred container has 6 layers and three different materials to provide barrier properties. The outside layer of the container is virgin HDPE of a nominal thickness of about 5 mils. The adjacent layer is the thickest layer at about 18 mils and is made of reground trim and scrap from earlier made containers. The middle layer is a half mil thick EVOH layer. The inner layer of the container is another 5 mils of virgin HDPE. Bonding the EVOH layer to the reground layer and the inner HDPE layer is a half mil thick tie layer made of BYNEL®, an adhesive and Trademark of E. I. DuPont de Nemours Co. of Wilmington, Del. The target moisture and oxygen transmission levels in the preferred embodiment is less than 0.004 g of water per package per 24 hour day at 70 degrees F and 50% RH. For oxygen the preferred target is less than 0.02 cc of oxygen per package per 24 hour day at 79 degrees F and 50% RH. This can be achieved with 20–25 mils of HDPE to provide the moisture barrier and 0.05 mils of EVOH to provide the oxygen barrier. Preferably the EVOH is towards the inside of the package to keep the EVOH dry to improve its oxygen barrier properties. The layered structure preferably has a total thickness of 25–30 mils to provide the barrier properties and strength required. However, the strength of the container can be changed by increasing or decreasing the HDPE and regrind layers proportionally. Preferably the EVOH and tie layers remain constant since they are the more expensive layers and a minimum of 0.5 mils is needed to maintain barrier and continuous layers in the blow molding process.

The 6 different layers exit the extrusion die as a continuous multi-layer plastic tube, which is the parison. The preferred structure requires four extruders (one for virgin HDPE, one for regrind, one for BYNEL, and one for EVOH). The multi-ring extruder die splits the plastic flow from one extruder into two layers for the HDPE and BYNEL resins.

The multi-layer tube is then moved to a molding station where the tube is dropped between two blow mold cavities and then pinched flat by the mold cavities as they close around the parison. Air is then blown into the parison tube via a blow pin to cause the parison to expand against the inside of the mold cavities. The pinchoff of the tube causes flash that is later removed after the molded container has cooled. Air pressure and time and rate of blowing are controlled to obtain the desired blow molded part dimensions. After cooling the blow molded part, the mold cavities are opened to release the part, which is trimmed of flash in a downstream operation.

Figure 8:
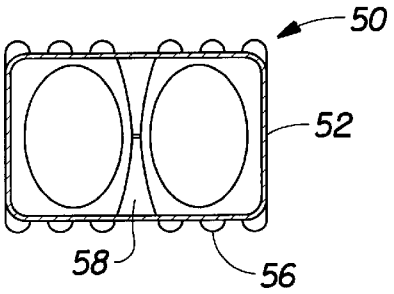
FIG. 8 is a sectioned top plan view thereof, taken along section line 8—8 of FIG. 7, showing the two compartments and the vertical ribs and center partition.
Figure 7:
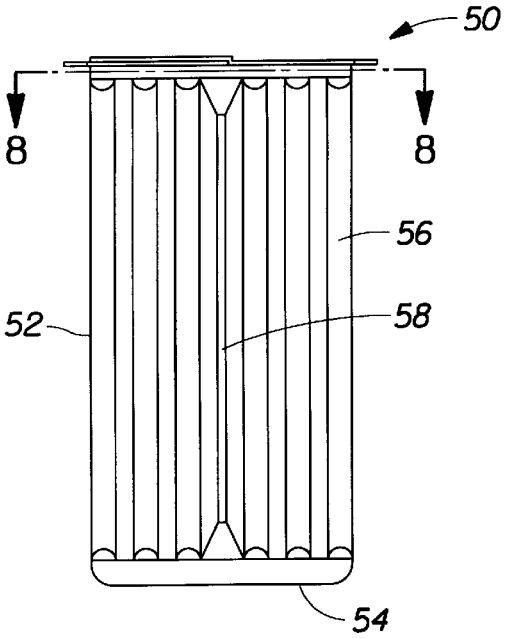
FIG. 7 is a front elevation view of an alternative embodiment of the container of the present invention, disclosing a plastic container having vertically instead of horizontally corrugated front side walls and front and back indentations that do not extend all the way to the bottom end of the container.
Figure 9:
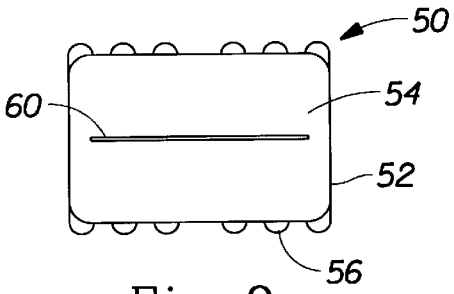
FIG. 9 is a bottom plan view thereof, showing a single bottom portion having a vertical rib substantially centered and parallel to the front and back sides.

A first alternative container embodiment, generally indicated as 50, is shown in FIGS. 7, 8, and 9. Container 50 is identical to container 10 except for front and back side walls 52 and bottom end 54. Side walls 52 have vertically oriented corrugations 56 instead of horizontal corrugations 22. While horizontally oriented corrugations provide deflection resistance laterally across the front or back side walls, vertically oriented corrugations provide deflection resistance longitudinally across these side walls.

Container 50 has a single closed bottom because an internal partition 58 does not extend all the way to the bottom of the container. The closed bottom has a pushup (not shown) for molding purposes and a rib 60 extends across the closed bottom, as shown in FIG. 9 to stiffen the closed bottom. This rib is formed at the pinch-off of the parison, and it is also known as the pinch-off rib.

Figure 11:
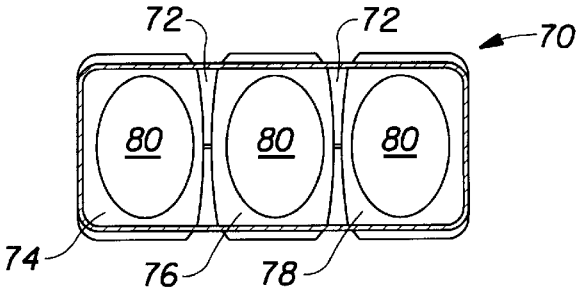
FIG. 11 is a sectioned top plan view thereof, taken along section line 11—11 of FIG. 10, showing three side-by-side stacks of oval articles separated by two partitions, which are formed by the front and back side wall indentations.
Figure 10:
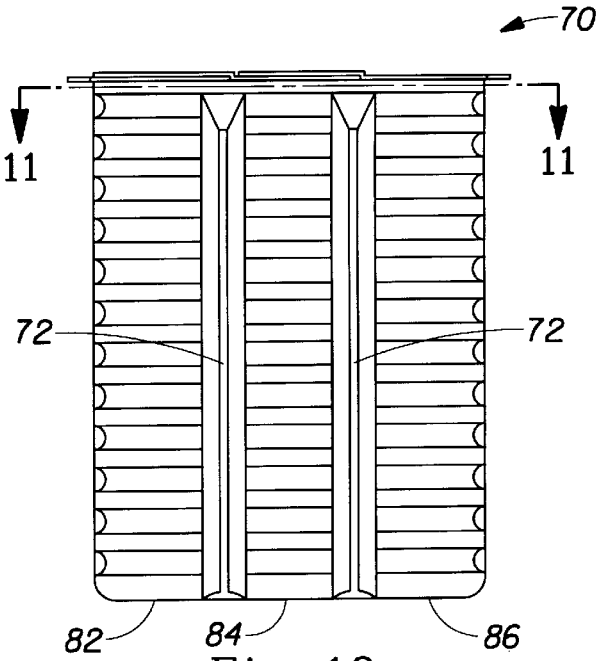
FIG. 10 is a front elevation view of another alternative embodiment of the container of the present invention, disclosing a plastic container having two indentations, instead of one indentation, which extend to the bottom end of the container.
Figure 12:
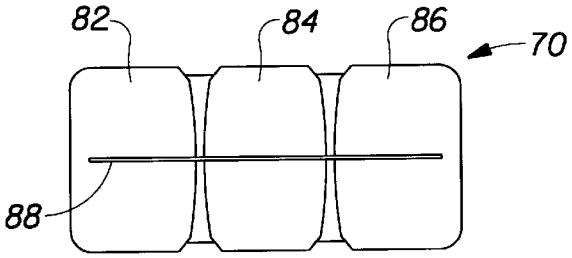
FIG. 12 is a bottom plan view thereof, showing three separate bottom portions connected together by a vertical rib substantially centered and parallel to the front and back sides.

A second alternative container embodiment, generally indicated as 70, is shown in FIGS. 10, 11, and 12. Container 70 is identical to container 10 except that it has two internal partitions 72 and three separated compartments 74, 76, and 78 for three stacks of fragile articles 80, and it has three bottom portions 82, 84, and 86 connected by a common rib 88. Also, container 70 is longer and has three peelable closures 90, 92, and 94 for individually opening each of the three compartments. More than three compartments are clearly possible, but are not shown.

While particular embodiments of the present invention have been illustrated and described, it will be obvious to those skilled in the art that various changes and modifications may be made without departing from the spirit and scope of the invention, and it is intended to cover in the appended claims all such modifications that are within the scope of the invention.

What is claimed is:

1. A plastic container for multiple side-by-side stacks of fragile articles comprising:

a) a body having side walls and at least one internal partition extending from near a continuously rimmed open top to a bottom end of said body, said at least one partition having two spaced apart walls connected in a longitudinal plane substantially perpendicular to said at least one partition, said at least one partition forming at least two separated compartments within said body for supporting said stacks of fragile articles, said at least one partition providing resistance to squeezing said side walls so as to protect said stacks of fragile articles;

b) a closed bottom portion connected to each of said at least two separated compartments, said closed bottom portion of one compartment being separated from a closed bottom portion of another compartment by said two spaced apart walls of said at least one internal partition; and c) a reclosable closure located at said continuously rimmed top of said body which closes said at least two separated compartments.

2. The container of claim 1 wherein said side walls are corrugated from said continuously rimmed top end to said bottom end of said single blow molded body to increase stiffness of said side walls to squeezing in order to further protect said stacks of fragile articles from damage.

3. The container of claim 2, wherein said corrugations of said side walls are in the form of a continuous sinusoidal wave.

4. The container of claim 1 wherein said single body is substantially rectangular in shape in order to reduce an overall size of said container for ease of one-handed handling.

5. The container of claim 1, wherein said body is blow molded from a multilayer parison comprising layers of high density polyethylene, ethylene vinyl alcohol, and adhesive tie layers to provide low cost structure meeting the preferred moisture and oxygen barrier targets.

6. The container of claim 1 further comprising a substantially rigid pinch off rib located within a pushup region at said bottom end, said rib being substantially parallel to said longitudinal plane and connected to said closed bottom portion of each compartment to stiffen said closed bottom portion in the presence of vacuum and pressure in said container.

7. The container of claim 1 further comprising overlapping peel closures for each of said at least two separated compartments, said overlapping peel closures located inside said reclosable closure, said overlapping peel closures being removable one at a time in order to retain said multiple stacks of fragile articles in said at least two separated compartments while one of said at least two compartments is opened for removal of one of said multiple stacks of fragile articles.

8. The container of claim 1 wherein said two spaced apart walls are adapted to deform in the presence of vacuum and pressure occurring in said at least two spaced apart compartments such that an outer perimeter dimension of said body remains substantially constant.

9. The container of claim 8, wherein said side walls further comprise substantially flat end portions for attaching a wrap around label.

10. The container of claim 1, wherein said container is adapted to be pressurized and said peel closures provide a gas-tight seal with said body.

11. A plastic container for multiple side-by-side stacks of fragile articles comprising:

a) a single blow molded body having side walls and at least one internal partition extending from near a continuously rimmed open top to near a closed bottom end of said single blow molded body, said at least one partition having two spaced apart walls connected in a longitudinal plane substantially perpendicular to said at least one partition, said at least one partition forming at least two separated compartments within said body for supporting said fragile articles and providing resistance to squeezing said side walls so as to protect said stacks of fragile articles, said two spaced apart walls adapted to deform in the presence of vacuum and pressure occurring in said at least two spaced apart compartments such that an outer perimeter dimension of said body remains substantially constant; and b) a reclosable closure located at said continuously rimmed top end of said body which closes said at least two separated compartments.

12. The container of claim 11 wherein said side walls are corrugated from said continuously rimmed top end to said closed bottom end of said single blow molded body to increase stiffness of said side walls to squeezing in order to further protect said multiple side-by-side stacks of fragile articles from damage.

13. The container of claim 11 wherein said single blow molded body is substantially rectangular in shape in order to reduce an overall size of said container for ease of one-handed handling.

14. The container of claim 11 wherein said single blow molded body is blown from a multilayer parison comprising layers of high density polyethylene, ethylene vinyl alcohol, and adhesive tie layers to provide lowest cost structure meeting the preferred moisture and oxygen barrier targets.

15. The container of claim 11 further comprising a substantially rigid pinch off rib located within a pushup region at said closed bottom end, said rib being substantially parallel to said longitudinal plane to stiffen said closed bottom end in the presence of vacuum and pressure in said container.

16. The container of claim 11 further comprising overlapping peel closures for each of said at least two separated compartments, said overlapping peel closures located inside said reclosable closure, said overlapping peel closures being removable one at a time in order to retain said multiple stacks of fragile articles in said at least two separated compartments while one of said at least two compartments is opened for removal of one of said multiple side-by-side stacks of fragile articles.

17. A plastic container for multiple side-by-side stacks of fragile articles, comprising:

a body having side walls and at least one internal partition extending from near a continuously rimmed open top to a bottom end of said body, said at least one partition having two spaced apart walls connected in a longitudinal plane substantially perpendicular to said at least one partition, said at least one partition forming at least two separated compartments within said body for supporting said stacks of fragile articles, said two spaced apart walls adapted to deform in the presence of vacuum and pressure occurring in said at least two spaced apart compartments such that the outer perimeter of said body remains substantially constant, said at least one partition providing resistance to squeezing said side walls so as to protect said stacks of fragile articles;

a closure located at said continuously rimmed top of said body which closes said at least two separated compartments; and wherein said body is adapted to be pressurized and said closure provides a gas-tight seal with said body.

18. The container of claim 17, wherein said side walls further comprise substantially flat end portions for attaching a wrap around label.

* * * * *

UNITED STATES PATENT AND TRADEMARK OFFICE

CERTIFICATE OF CORRECTION

PATENT NO. : 5,921,429

DATED : July 13, 1999

INVENTOR(S) : Dana P. Gruenbacher et al.

It is certified that error appears in the above-identified patent and that said Letters Patent is hereby corrected as shown below:

*Column 10, Claim 14, line 1, delete "single blow molded".*

*Column 10, Claim 14, line 2, delete "blown" and insert therefor -- blow molded --.*

Signed and Sealed this

Thirteenth Day of June, 2000

*Attest:*

Q. TODD DICKINSON

*Attesting Officer*

*Director of Patents and Trademarks*